United States Patent [19]

Tessera-Chiesa

[11] Patent Number: 4,874,096

[45] Date of Patent: Oct. 17, 1989

[54] SEALED PACKET WITH AN ADHESIVE STRIP FOR OPENING AND RECLOSING

[75] Inventor: Emilio Tessera-Chiesa, Leumann, Italy

[73] Assignee: Sales S.p.A., Turin, Italy

[21] Appl. No.: 215,153

[22] Filed: Jul. 5, 1988

[30] Foreign Application Priority Data

Jul. 2, 1987 [IT] Italy ..... 53496/87[U]

[51] Int. Cl.[4] ..... B65D 3/26; B65D 33/36

[52] U.S. Cl. ..... 206/621; 206/459; 206/610; 206/626; 206/630; 206/632; 206/633; 206/807; 383/5

[58] Field of Search ..... 206/605, 607, 610, 613, 206/615, 621, 628, 630, 631.1, 632, 633, 459, 807, 626, 634; 383/5

[56] References Cited

U.S. PATENT DOCUMENTS

| | | | |
|---|---|---|---|
| 3,175,752 | 3/1965 | Stabenow | 206/613 X |
| 3,373,926 | 3/1968 | Voightman et al. | 206/613 |
| 3,783,996 | 1/1974 | Gerard et al. | 206/807 X |
| 3,836,039 | 9/1974 | Sevferth et al. | 206/613 X |
| 3,859,581 | 12/1974 | Jones Jr. | 206/807 X |
| 3,896,965 | 7/1975 | Cornell | 206/807 X |
| 4,053,046 | 10/1977 | Roark | 206/610 X |
| 4,679,693 | 7/1987 | Forman | 206/610 |
| 4,698,509 | 3/1987 | Alves | 206/459 |
| 4,709,399 | 11/1987 | Sanders | 383/5 X |

*Primary Examiner*—Bryon P. Gehman

*Attorney, Agent, or Firm*—Sughrue, Mion, Zinn, Macpeak & Seas

[57] ABSTRACT

A sealed packet containing food products in pieces, particularly sweets and the like, has an adhesive strip applied in a partially detachable and reattachable manner to a wall of the packet in correspondence with a shaped cut therein, so as to achieve controlled tearing of the wall during the first detachment of the adhesive strip, in order to define an opening through which the products in the packet can be removed. The adhesive strip is transparent and an indicator is associated therewith to provide an indication of any fraudulent opening of the packet.

6 Claims, 2 Drawing Sheets

SEALED PACKET WITH AN ADHESIVE STRIP FOR OPENING AND RECLOSING

BACKGROUND OF THE INVENTION

The present invention relates to an adhesive strip for opening and closing sealed packets containing food products in pieces, particularly sweets and the like, of the type comprising an adhesive strip provided at one end with a non-adhesive gripper tongue and applied in a partially detachable and re-attachable manner to the wall of the packet in correspondence with a shaped cut therein, so as to achieve controlled tearing of the wall during first detachment of the adhesive strip to define an opening through which the products can be taken from the packet, the opening being reclosable by re-attachment of the adhesive strip.

SUMMARY OF THE INVENTION

The object of the present invention is to provide a device of the type specified above, having means for effectively indicating any fraudulent opening which are simple to manufacture and are extremely practical. This object is achieved by virtue of the fact that the said adhesive strip is transparent and that indicator means are provided comprising a supplementary strip having a width which is less than the length of the adhesive strip and being disposed beneath the adhesive strip, transverse thereto, the supplementary strip extending through the cut in the packet and being operatively connected to the adhesive strip to modify its condition in a visually perceptible manner during the tearing of the wall of the packet as a result of the first detachment of the adhesive strip.

According to a first solution, the supplementary strip has a length substantially equal to the width of the adhesive strip, has a very sticky adhesive face applied to the wall of the packet and a slightly sticky face applied to the adhesive face of the adhesive strip, and also has a limited resistance to tearing.

Thus, during the first detachment of the adhesive strip, a breaking tension is applied to the supplementary strip due to the entrainment of its central zone by the torn wall of the packet, while the ends of the supplementary strip remain achored to the wall of the packet, beyond its zone of tearing. The tearing of the supplementary strip thus caused is clearly visible from the exterior through the transparent adhesive strip following reclosure of the packet.

In order to facilitate tearing of the supplementary strip, the latter may conveniently be provided with pre-cut transverse lines.

Moreover, in order to render the tearing of the supplementary strip even clearer, the slightly sticky adhesive face may have a peelable surface or this supplementary strip may be formed from a material which can change colour as a result of the stretching caused by the tearing.

According to another solution, the supplementary strip has a length greater than the width of the part of the packet which has the cut, the supplementary strip being fixed at its centre to the face of the wall of the packet opposite the adhesive strip with its ends projecting freely beyond the cut in the wall, and these ends having a visual appearance which is immediately detectable and being adapted to be drawn against the face of the wall of the packet to which the adhesive strip is applied following the first detachment thereof.

Thus, after the first detachment of the adhesive strip, the ends of the supplementary strip, which are conveniently of a colour contrasting with that of the packet, will be kept outside the zone of tearing of the packet so as to be identifiable immediately through the transparent adhesive strip following reclosure of the packet.

BRIEF DESCRIPTION OF THE DRAWINGS

The invention will now be described in detail with reference to the appended drawings, provided purely by way of non-limiting example, in which.

DETAILED DESCRIPTION OF THE INVENTION

Figure 1:
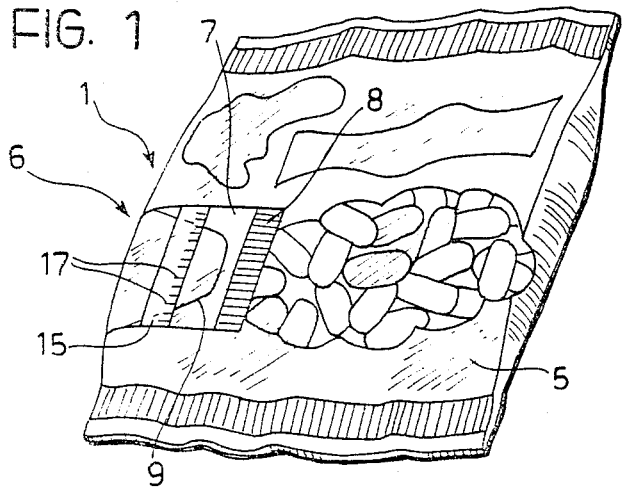
FIG. 1 is a schematic perspective view of a sweet packet provided with an opening and closing adhesive strip according to the invention, illustrated in the configuration before the first opening.

With referece initially to FIG. 1, a packet containing food products in the form of pieces is generally indicated 1 and is provided with an opening and closing device, generally indicated 6, of the type which is the subject.

For the purposes of the present invention, it suffices to say that the device 6 includes an adhesive strip 7 provided at one end with a non-adhesive manual gripper tongue 8 and applied to a wall 5 of the packet 1 in correspondence with a zone having a cut 9 constituted by a substantially arcuate line of punching. The adhesive strip 7 is transparent and has a width greater than the extent of the cut 9 so as to cover it completely.

Figure 2:
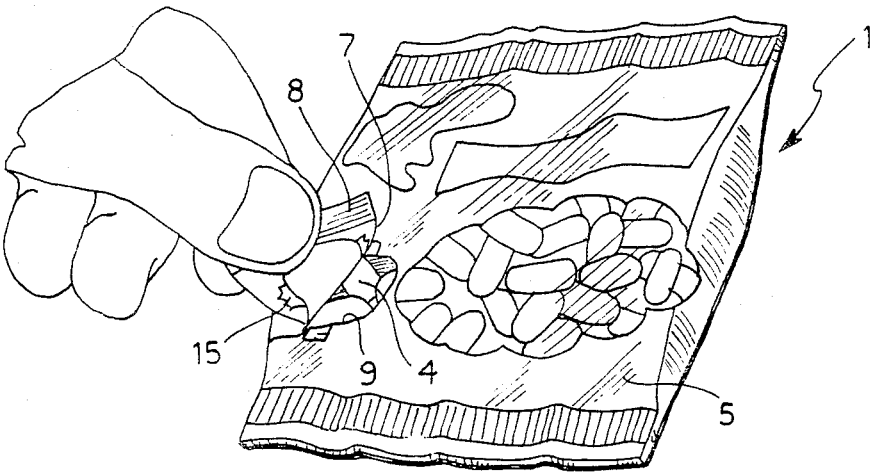
FIG. 2 is a view similar to FIG. 1, showing the packet during the act of first opening.
Figure 3:
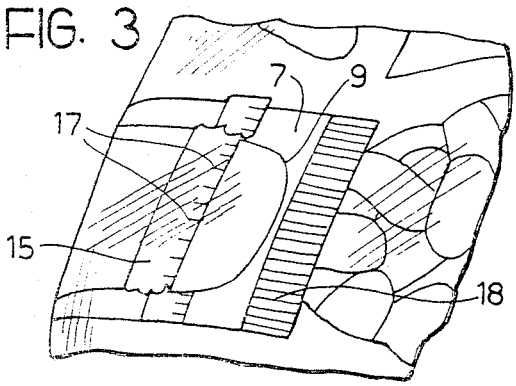
FIG. 3 shows a detail of the packet on an enlarged scale, following its reclosure.

The condition illustrated in FIG. 1 corresponds to that in which the packet 1 is sold. In this condition, the packet is perfectly sealed by means fo the hermetic closure of the cut 9 by the adhesive strip 7. In order to open the packet 1 to allow the removal of its contents, it suffices to grip the gripper tongue 8 and pull the adhesive strip 7 so as to tear the wall 5 as a result of the entrainment of its portion bounded by the cut 9. Thus, an opening 4 is formed in the wall 5 through which the contents of the packet 1 may be removed (FIG. 2). In order to close the packet 1, it suffices to re-apply the adhesive strip 7 to the wall 5, restoring the initial condition shown in FIG. 1 (FIG. 3).

Means are provided for limiting the length of detachment of the strip 7. These means may be constituted by heat sealing of the strip 7 to the wall 5 of the packet.

In order to provide a sure indication of any fraudulent opening of the packet 1 before its acquisition by the consumer, the invention provides a supplementary strip 15, normally of paper or similar material, disposed beneath the adhesive strip 7. The supplementary strip 15 has a width less than the length of the adhesive strip 7 and is disposed transversely beneath it, so as to extend through the cut 9 in the wall 5 of the packet 1. In the case of FIGS. 1 to 3, the supplementary strip 15 has a length substantially equal to the width of the adhesive strip 7 and is interposed between this and the wall 5 of the packet 1. In effect, the face of the supplementary strip 15 facing the wall 5 of the packet 1 is covered with a very sticky adhesive material and is thus firmly stuck to this wall 5, while the opposite face of the strip 15 is covered with a slightly sticky (for example, slightly siliconated) adhesive in contact with the adhesive face of the strip 7.

The supplementary strip 15 has a low resistance to tearing, and this may be accentuated by the formation of pre-cut transverse lines 17 in correspondence with its longitudinal edge facing away from the non-adhesive tongue 8.

In addition or alternatively, the visible face of the supplementary strip 15, that is, the one facing the adhesive strip 7, may be provided with a peelable surface or alternatively this supplementary strip 15 may be formed of a material known per se, which can change colour as a result of tensioning.

In the condition of sale of the packet 1 illustrated in FIG. 1, the supplementary strip 15 is intact and this integrity may be checked visually through the adhesive strip 7.

During the first detachment of the adhesive strip 7, which causes the controlled tearing of the wall 5 of the packet 1 in the zone of the cut 9, the supplementary strip 15 is pulled and broken due to the entrainment of its central part by the torn zone of the wall 5 of the packet 1, while its end zones remain firmly fixed to the wall 5 of the packet 1, beyond the edges of the cut 9. This results in a double tearing of the strip 15 in the manner illustrated in FIG. 2, since the slightly sticky face of this strip 15 creates a limited resistance to detachment from the adhesive strip 7, while the opposite very sticky face in contact with the wall 5 of the packet 1 creates an adhesive force on the packet itself in the zone outside the torn zone. The double tearing of the supplementary strip 15 will indicate clearly that the packet 1 has been opened after its reclosure, as may be seen immediately through the strip 7 due to its transparency, in the manner illustrated in FIG. 3. Should the visual check give rise to some doubt, it is easy to find out whether or not the supplementary strip 15 has already been torn by opening the packet 1 and ascertaining whether or not there is a certain resistance to the removal of the adhesive strip 7. The visual information may be further accentuated by possible recourse to the supplementary devices specified above (peelable surface and material which changes colour as a result of pulling on the supplementary strip 15).

Figure 4:
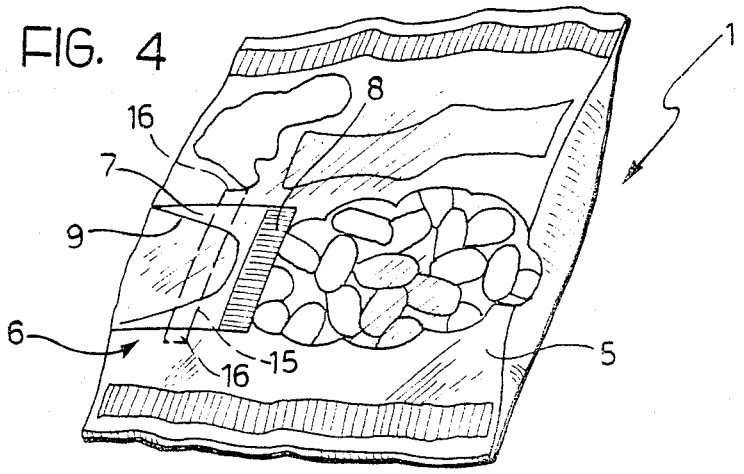
FIGS. 4, 5 and 6 are views of a variant of the invention, corresponding to FIGS. 1, 2 and 3.
Figure 5:
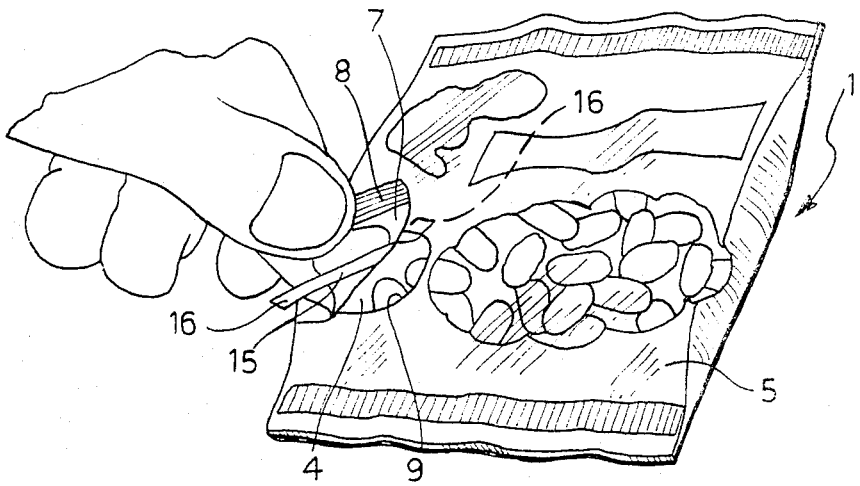
Figure 6:
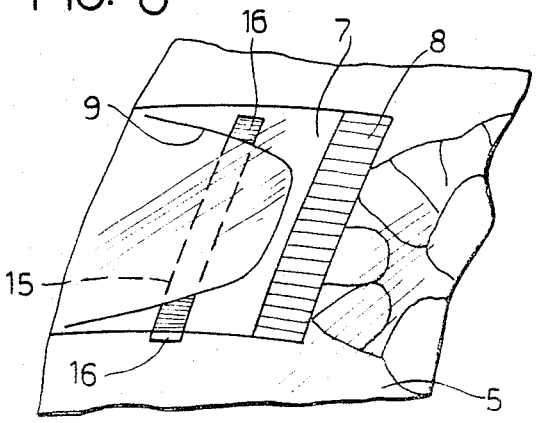

The solution shown in FIGS. 4 to 6, however, provides for the use of a supplementary strip 15 longer than the width of the portion of the wall 5 of the packet 1 defined by the cut 9, so that it has ends 16 which project relative thereto. These ends 16 have an appearance which is immediately detectable, for example, a colour which contrasts with that of the wall 5 of the packet 1.

In this case, the supplementary strip 15, instead of being interposed between the adhesive strip 7 and the wall 5, is disposed within the packet 1 against the inner face of the wall 5, and is fixed at its centre by means of adhesive to the zone of this wall 5 circumscribed by the cut 9. The ends 16, however, are free,that is, not anchored to the wall 5.

In the condition of sale of the packet 1, illustrated in FIG. 4, the supplementary strip 15 is therefore invisible from outside in that it is covered by the wall 5 which is normally non-transparent.

During the first opening, the tearing of the zone surrounding the cut 9 produced by the removal of the adhesive strip 7 causes the supplementary strip 15 to be drawn to the outside so that its ends 16 project from the aperture 4 (FIG. 5).

Following the subsequent reclosure of the packet 1, the ends 16 are placed between the adhesive strip 7 and the outer face of the wall 5 beyond the margins of the cut 9, and are thus immediately detectable from the exterior through the transparent strip 7, indicating unequivocally that the packet 1 has been opened (FIG. 6).

What is claimed is:

1. A packet with an adhesive strip for opening and closing a wall of said sealed packet containing food products in the form of pieces, particularly but not exclusively sweets and the like, and having a shaped cut in said wall, said adhesive strip being transparent and having an adhesive face with a non-adhesive gripper tongue at one end and applied in a partially detachable and re-attachable manner to the wall of the packet in correspondence with the cut therein, so as to achieve controlled tearing of the wall during first detachment of the adhesive strip in order to define an opening through which the products in the packet can be removed, said opening being reclosable by re-attachment of the adhesive strip, and indicator means associated with the adhesive strip to provide indications of any fraudulent opening of the packet, wherein the indicator means comprise a supplementary strip having a width which is less than the length of the adhesive strip and being disposed transversely beneath the adhesive strip, the supplementary strip extending through the cut in the packet and being operatively connected to the adhesive strip in such a manner that its condition is modified in a visually perceptible manner during the tearing of the wall during first detachment of the adhesive strip.

2. A packet according to claim 1, wherein the supplementary strip has a length substantially equal to the width of the adhesive strip, has a very sticky adhesive face applied to the wall of the packet and a slightly sticky adhesive face applied to the adhesive face of the adhesive strip, and also has a limited resistance to tearing.

3. A packet according to claim 2, wherein the supplementary strip has transverse pre-cut lines which face the non-adhesive tongue of the adhesive strip.

4. A packet according to claim 2, wherein the slightly sticky face of the supplementary strip has a peelable surface.

5. A packet according to claim 1, wherein the supplementary strip is of a material which can change its colour as a result of the application of stress thereto during final detachment of said adhesive strip.

6. A packet according to claim 1, wherein the supplementary strip has a length greater than the width of the part of the packet bounded by the cut and is fixed at its centre to the face of the wall of the packet opposite the adhesive strip with its ends projecting freely beyond the cut of the wall, these ends having an immediately detectable visual appearance and being adpated to be drawn against the face of the wall of the packet on which the adhesive strip is applied as a result of the first detachment thereof.

* * * * *